US009162273B1

(12) United States Patent
Chiu

(10) Patent No.: US 9,162,273 B1
(45) Date of Patent: Oct. 20, 2015

(54) PIPE BENDER

(71) Applicant: Sheng-Chih Chiu, Taichung (TW)

(72) Inventor: Sheng-Chih Chiu, Taichung (TW)

( * ) Notice: Subject to any disclaimer, the term of this patent is extended or adjusted under 35 U.S.C. 154(b) by 0 days.

(21) Appl. No.: 14/463,811

(22) Filed: Aug. 20, 2014

(51) Int. Cl.

| | |
|---|---|
| ***B21D 7/08*** | (2006.01) |
| ***B21D 7/06*** | (2006.01) |
| ***B21D 7/14*** | (2006.01) |
| ***B21D 7/022*** | (2006.01) |

(52) U.S. Cl.
CPC *B21D 7/06* (2013.01); *B21D 7/022* (2013.01); *B21D 7/063* (2013.01); *B21D 7/14* (2013.01)

(58) Field of Classification Search
CPC ..... B21D 7/06; B21D 7/14; B21D 7/022; B21D 7/063
See application file for complete search history.

(56) References Cited

U.S. PATENT DOCUMENTS

| | | | | |
|---|---|---|---|---|
| 4,989,441 | A * | 2/1991 | Wagner | 72/390.2 |
| 5,237,847 | A * | 8/1993 | Owens | 72/213 |
| 5,761,950 | A * | 6/1998 | Chiu | 72/390.5 |
| 6,865,921 | B2 * | 3/2005 | Simonian | 72/390.4 |
| 6,931,908 | B1 * | 8/2005 | Mitson | 72/390.2 |
| 7,624,612 | B2 * | 12/2009 | Toda et al. | 72/390.6 |

* cited by examiner

*Primary Examiner* — David B Jones
(74) *Attorney, Agent, or Firm* — Rosenberg, Klein & Lee

(57) ABSTRACT

A pipe bender includes an actuating handle having an actuating element movably installed at the actuating handle and controllable to move in order to extend in an axial direction of the actuating handle, and a support arm transversally spanned over the actuating handle and having a support device disposed at both ends of the actuating handle separately and slidable along the support arm. Each support device includes a base with a grip portion, and a grip space formed in the grip portion, and the base is sheathed from the grip space on the support arm through the grip portion, and the support device includes a positioning mechanism for sliding and moving the support device to a selected position and then positioning the support device on the support arm.

7 Claims, 13 Drawing Sheets

PIPE BENDER

FIELD OF THE INVENTION

The present invention relates to a pipe bender, in particular to the pipe bender having a support block capable of sliding on a support arm.

BACKGROUND OF THE INVENTION

With reference to FIG. 13 for a conventional pipe bender, the pipe bender comprises a longitudinally extended actuating handle 51, and a transversally extended support arm 52 spanned across the actuating handle 51 and intersected with the actuating handle 51 to form a T-shape. When use, a straight pipe 6 is pressed against the support blocks 53 at both ends of the support arm 52 respectively, and the actuating handle 51 is operated to press an actuating element 54 at the straight pipe 6 and push it in the longitudinal direction, continuously so that the straight pipe 6 is bent by the pushing force.

However, the two support blocks 53 of the aforementioned structure are fixed at a fixed position of the support arm 52 and cannot be adjusted according to the working conditions such as the length and diameter of the pipe to be bent 6, and thus the conventional pipe bender is inapplicable for various different types of pipes. On the other hand, the support arm 52 of the aforementioned design comes with a specific length, so that when the support arm 52 and the actuating handle 51 are integrally combined, the support arm 52 occupies too much space relative to the transversal expansion produced by the actuating handle 51, and thus it is inconvenient to store the conventional pipe bender. If the support arm 52 and the actuating handle 51 come with a modular design, the space occupied by the support arm 52 can be reduced to overcome the aforementioned issue, but it will take some time to assemble and disassemble the pipe bender for its use and storage, and thus the application is inconvenient.

SUMMARY OF THE INVENTION

Therefore, it is a primary objective of the present invention to overcome the aforementioned problem of the prior art by providing a pipe bender, and the pipe bender has a support arm with a telescopic structure provided for adjusting the outwardly extending length of the support arm to facilitate storage.

To achieve the aforementioned objective, the present invention provides a pipe bender, comprising: an actuating handle, movably installed at an actuating element and controllable to move in a longitudinal direction of the actuating handle; and a support arm, transversally spanned over the actuating handle, and having a support device disposed at both ends of the actuating handle separately and slidable along the support arm, for abutting the actuating element together with a pipe for a pipe bending operation; wherein each support device includes a base, and the base includes a pivotal support block, and the base includes a grip portion, and a grip space formed in the grip portion, and the base is sheathed from the grip space on the support arm through the grip portion so as to generate a sliding motion on the support arm, and the support device includes a positioning mechanism for positioning the support device at a selected position on the support arm.

Wherein, the base includes a column erected from the base, and the support block includes a through hole formed therein and sheathed on the column through the through hole.

The column has a fixing hole penetrating through the grip space, and the positioning mechanism includes a positioning element and an elastic element sequentially accommodated in the fixing hole, and a fixing element is passed into the through hole and fixed to the fixing hole, so that the elastic element abuts the fixing element, and the elastic force of the elastic element acts on the positioning element to push the positioning element against the support arm, so as to position the support device on the support arm; and the support arm includes a plurality of positioning portions provided for the positioning element to pick one of the positioning portions for positioning.

Further, the fixing hole of the column is a screw hole, and the fixing element has a screw provided for locking and securing with the screw hole.

In another preferred embodiment, the positioning mechanism includes a clutch portion disposed separately at the support arm and the base, and when the clutch portions of the support arm and the base are combined, the base can just slide and move in one direction along the support arm only, and if the clutch portions of the support arm and the base are separated, the base can move in both directions along the support arm. Preferably, the clutch portion of the support arm is the inverted tooth structure configured along the support arm, and the clutch of the base portion is a pivoting hook controlled to clutch the inverted tooth structure of the support arm.

In another preferred embodiment, the base has a specific length along the extending direction of the support arm, and a part of the base moves out from the support arm through the sliding motion of the base relative to the support arm. Wherein, the grip portion of the base has a containing hole concavely formed thereon, and the positioning mechanism includes an elastic element and a positioning element sequentially accommodated in the containing hole, so that the elastic force of the elastic element drives the positioning element to push the support arm to position the support device on the support arm, and the support arm includes a plurality of positioning portions disposed thereon and provided for the positioning element to pick one of the positioning portions for positioning.

The present invention will become clearer in light of the following detailed description of an illustrative embodiment of this invention described in connection with the drawings. It is intended that the embodiments and drawings disclosed herein are to be considered illustrative rather than restrictive.

DESCRIPTION OF THE PREFERRED EMBODIMENTS

Figure 1:
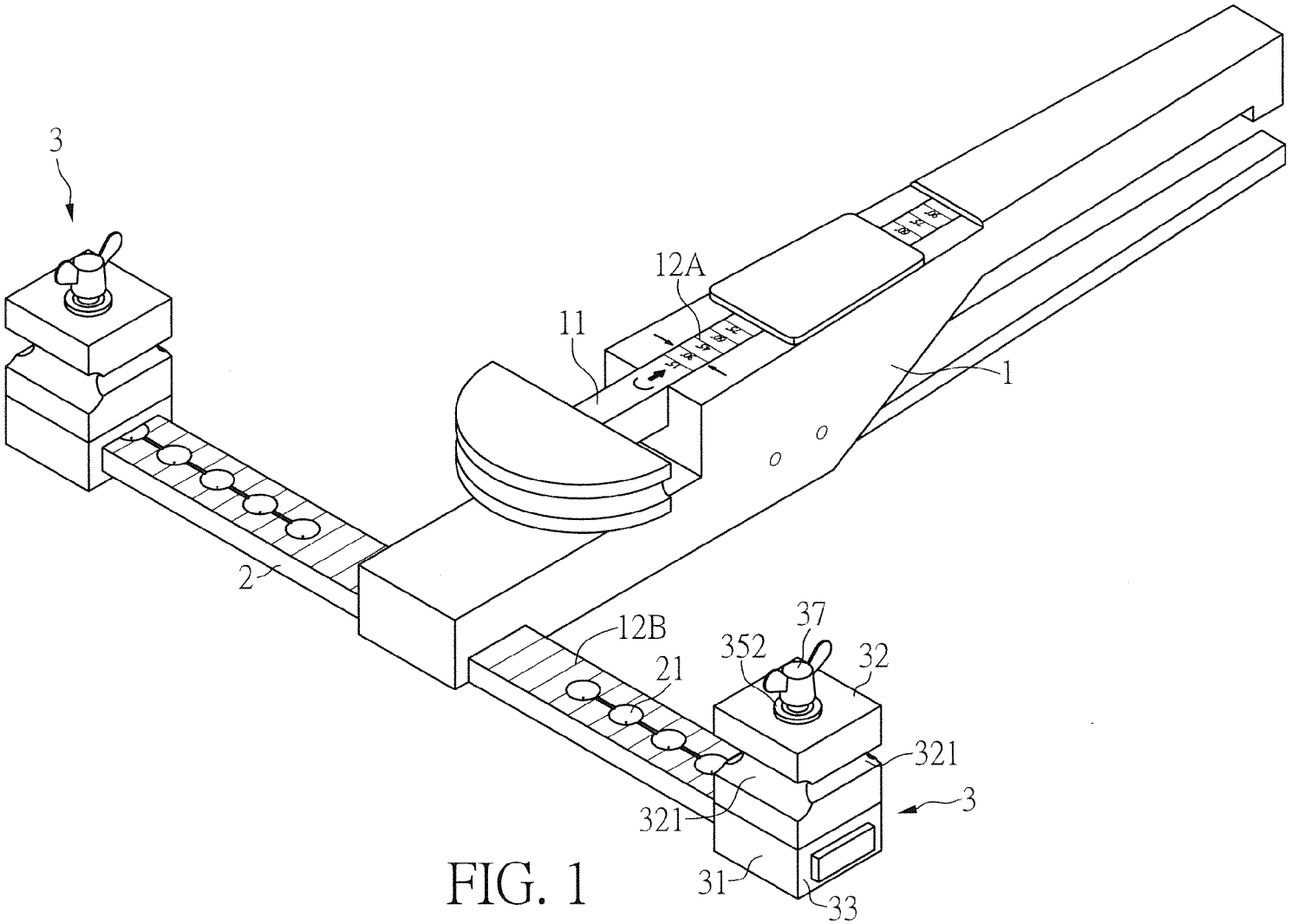
FIG. 1 is a perspective view of a first preferred embodiment of the present invention.
Figure 2:
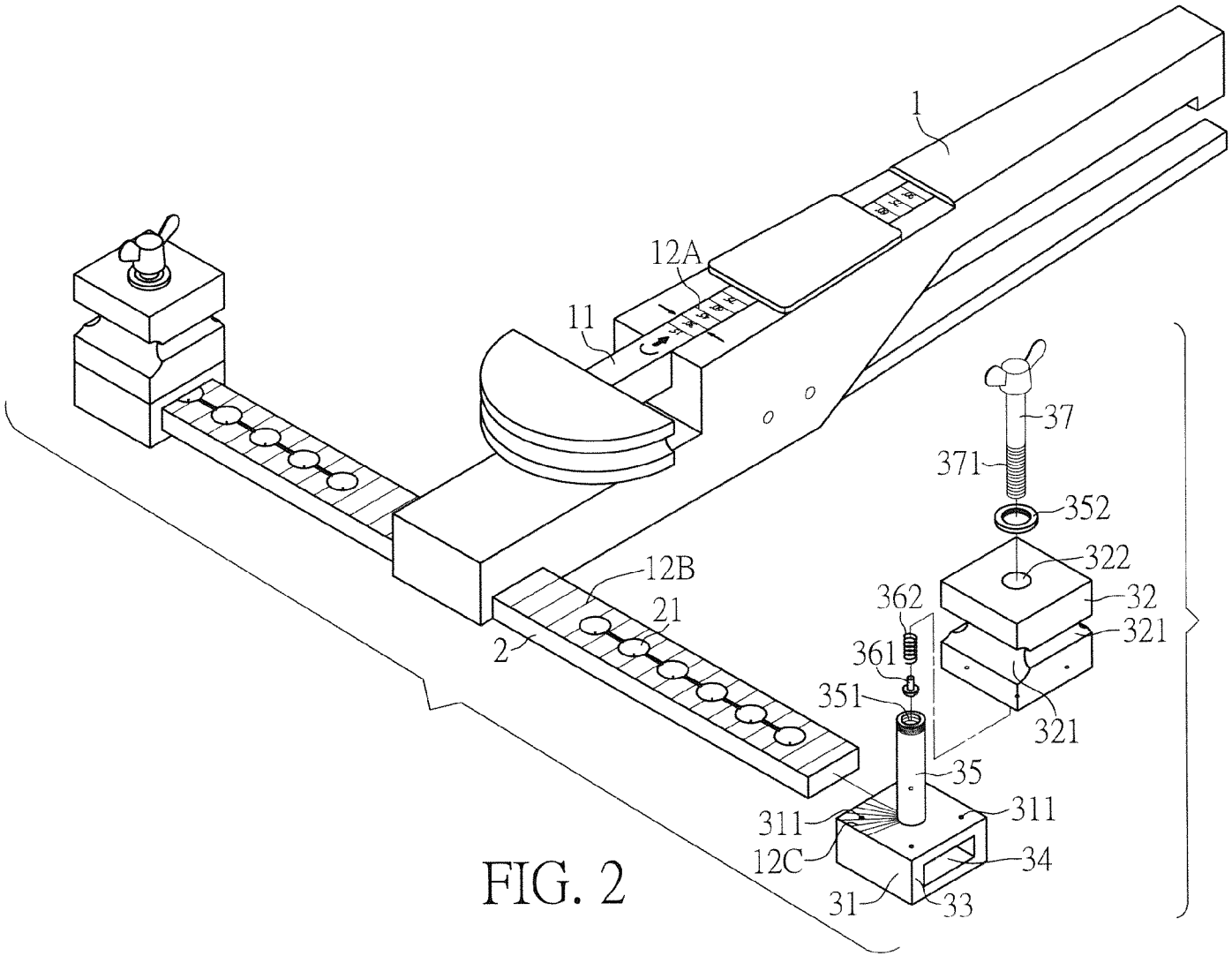
FIG. 2 is an exploded view of the first preferred embodiment of the present invention.

With reference to FIGS. 1 and 2 for a pipe bender of the first preferred embodiment of the present invention, the pipe bender comprises an actuating handle 1, and an actuating element 11 movably installed on the actuating handle 1 and controllable to move in a longitudinal direction of actuating handle 1. The principle and structure for the motion of the actuating element 11 are prior arts, and thus will not be described in details. The actuating handle 1 includes a support arm 2 installed across the actuating handle 1 to form a T-shape, and the support arm 2 includes a support device 3 installed at both ends of the actuating handle 1 separately and slidable along the support arm 2, wherein the support device 3 is provided for abutting the actuating element 11 against a pipe (not shown in the figure) to perform the pipe bending operation.

The support device 3 includes a base 31, and a support block 32 pivoted on the base 31. In this preferred embodiment, the support block 32 is a cube having a groove 321 formed at the periphery of the cube for supporting the pipe, and allowing users to change a support block of a different specification from the base 31. The base 31 has a grip portion 33 facing downward, and the grip portion 33 has a grip space 34 formed therein. The base 31 is disposed on the support arm 2, and the grip portion 33 is sheathed on the support arm 2 through the grip space 34. In other words, the grip portion 33 is a structure enclosing the support arm 2, and the specific structure of this preferred embodiment is a sheathing hole formed at the bottom of the base 31, and the sheathing hole is formed in the grip space 34. The support device 3 is sheathed on the support arm 2 through the sheathing hole of the base 31, and slidable on the support arm 2. The support device 3 includes a positioning mechanism for positioning the support device 3 at a selected position on the support arm 2.

Figure 3:
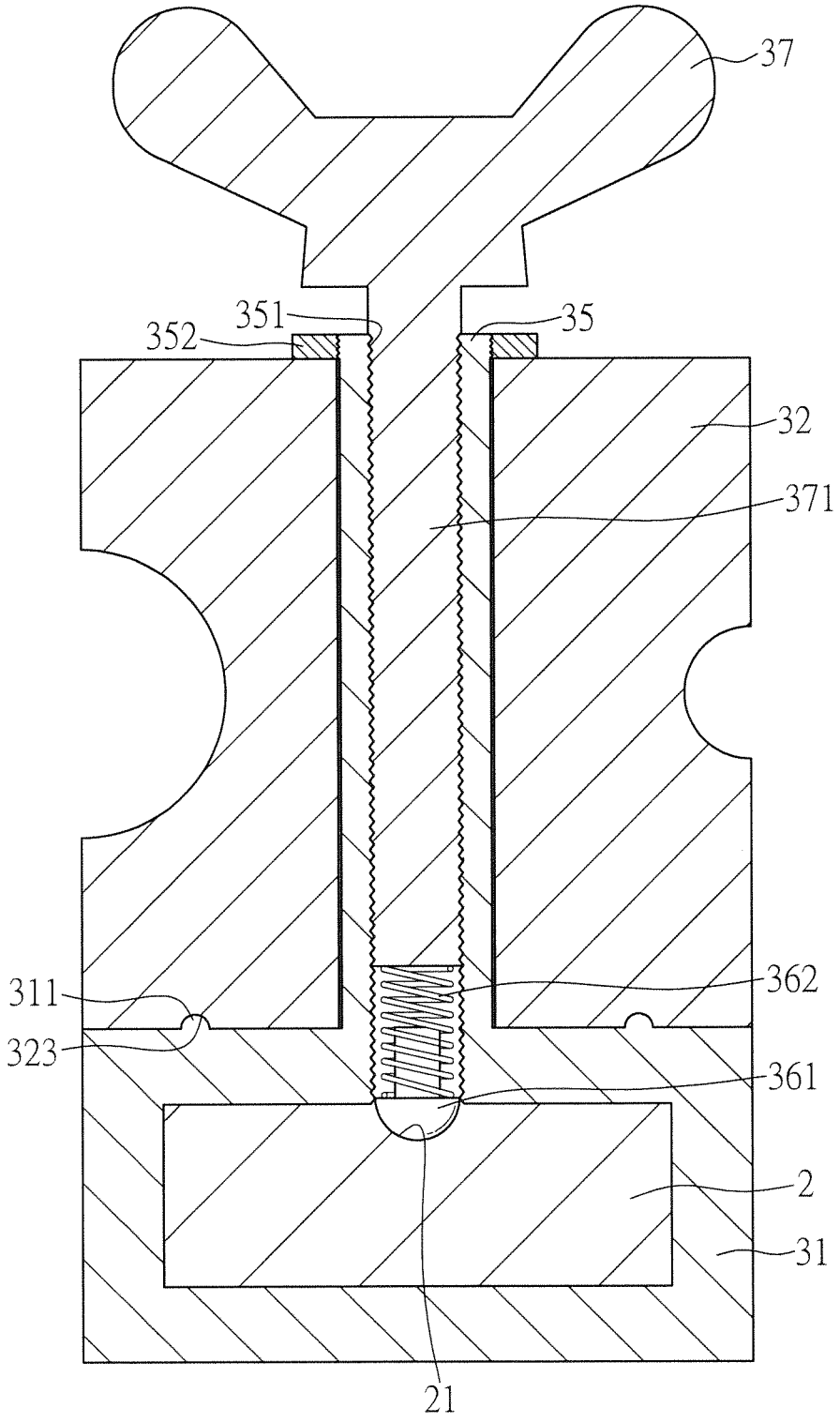
FIG. 3 is a sectional view of a support device and a support arm combined with each other in accordance with the first preferred embodiment of the present invention.
Figure 4:
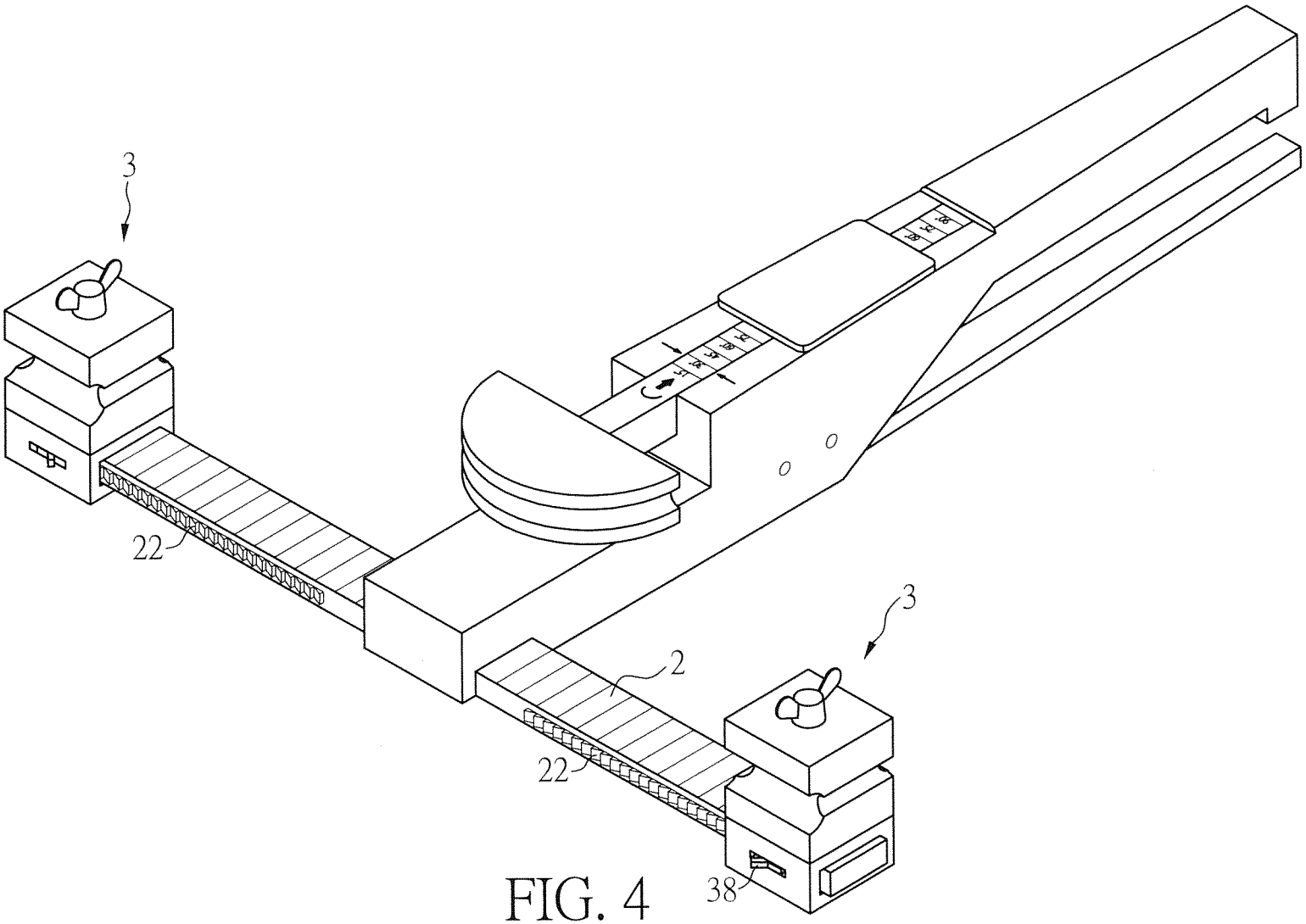
FIG. 4 is a perspective view of a second preferred embodiment of the present invention.
Figure 5:
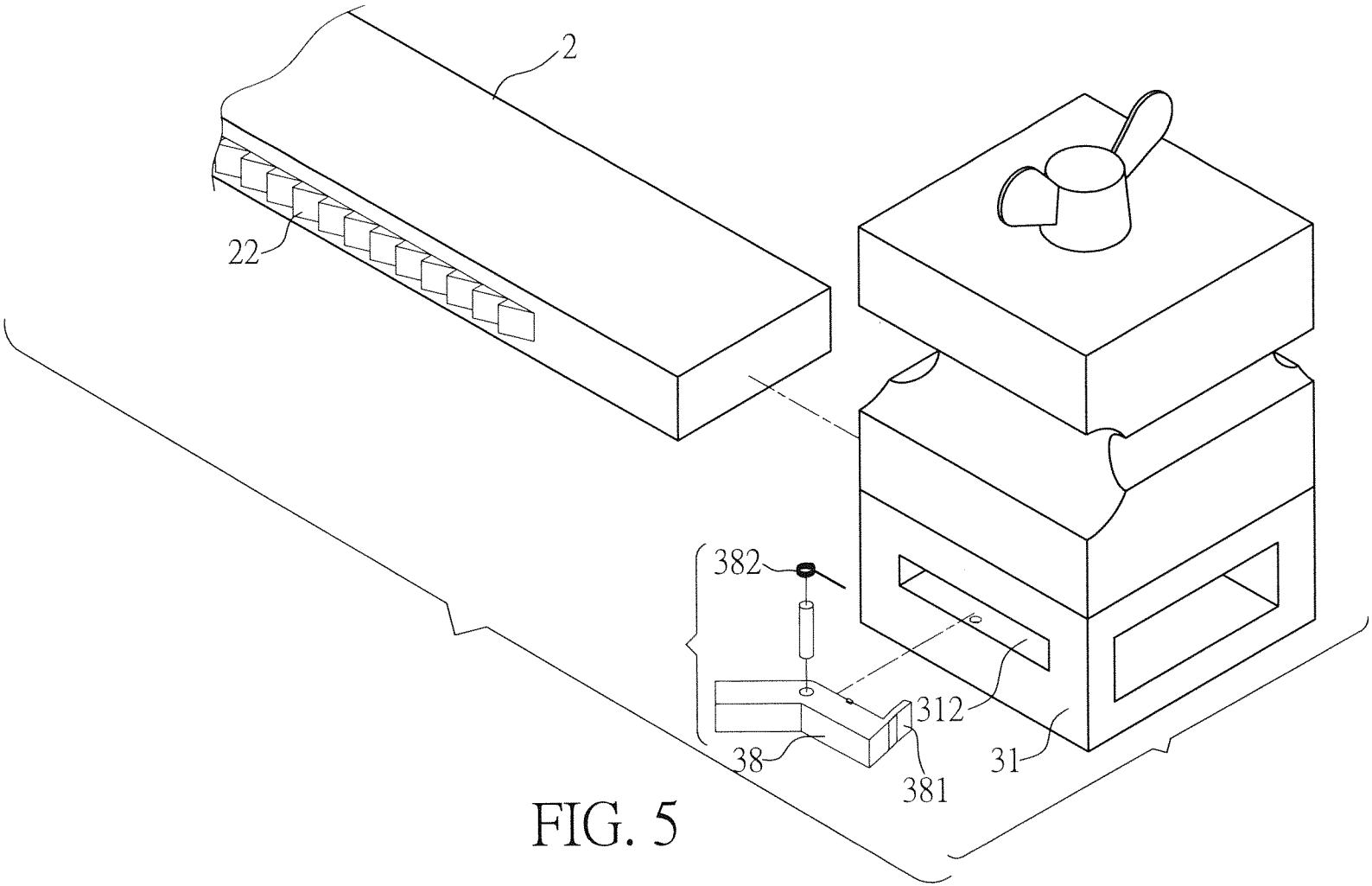
FIG. 5 is an exploded view of the second preferred embodiment of the present invention.

In FIGS. 1 to 3, the support device 3 includes a column 35 erected from the base 31, and the support block 32 has a through hole 322 formed therein and provided for sheathing the support block 32 on the column 35 through the through hole 322, and the support block 32 may be pivoted with respect to the column 35, and a blocking element 352 is installed at the top of the column 35 for preventing the support block 32 from falling off. The base 31 and the support block 32 have corresponding concave and convex positioning structures. For example, the base 31 has a bump 311, and the support block 32 has a corresponding recess 323 to provide a positioning effect between the support block 32 and the base 31. In this preferred embodiment, the column 35 has a fixing hole penetrating through the column 35 to the grip space 34, and the positioning mechanism includes a positioning element 361 and an elastic element (which is a spring 362 in this preferred embodiment) sequentially installed in the fixing hole, and a fixing element 37 passing into the through hole 322 and being fixed into the fixing hole, such that the spring 362 abuts against the fixing element 37. In this preferred embodiment, the fixing hole is a screw hole 351, and the fixing element 37 has a screw 371 extended from the fixing element 37 and secured into the screw hole 351. An end of the spring 362 abutting against the screw 371 forms a fixed end, and the other end of the spring 362 pushes the positioning element 361 by the elastic force of the spring 362, such that the positioning element 361 abuts the support arm 2 to fix the support device 3. In the support arm 2 includes a plurality of positioning portions 21 disposed thereon, and the positioning portion 21 is a recess for sliding the support device 3 to one of the recesses on the support arm 2 to position the support device 3 into the recess.

The screw 371 of the fixing element 37 is secured into the screw hole 351 to a certain depth to control the elastic force of the spring 362 abutting the positioning element 361, so as to adjust the strength of positioning the support device 3 on the support arm 2.

With the aforementioned structure of the present invention, the support device 3 is slid along the support arm 2 and moved to an appropriate position for positioning according to the diameter and length of the curved pipe in order to operate the actuating element 11 for a pipe bending operation. Wherein, the actuating element 11 has a calibration 12A that indicates a pipe bending angle to facilitate users to observe the progress of a pipe bending job. On the other hand, the support arm 2 and the base 31 also have calibrations 12B, 12C thereon respectively to indicate the position of the support device 3 and the rotating angle of the support block 32. Like the aforementioned calibration 12A of the actuating handle 1, these calibrations 12B, 12C also facilitate users to determine and set the operating conditions.

Figure 6:
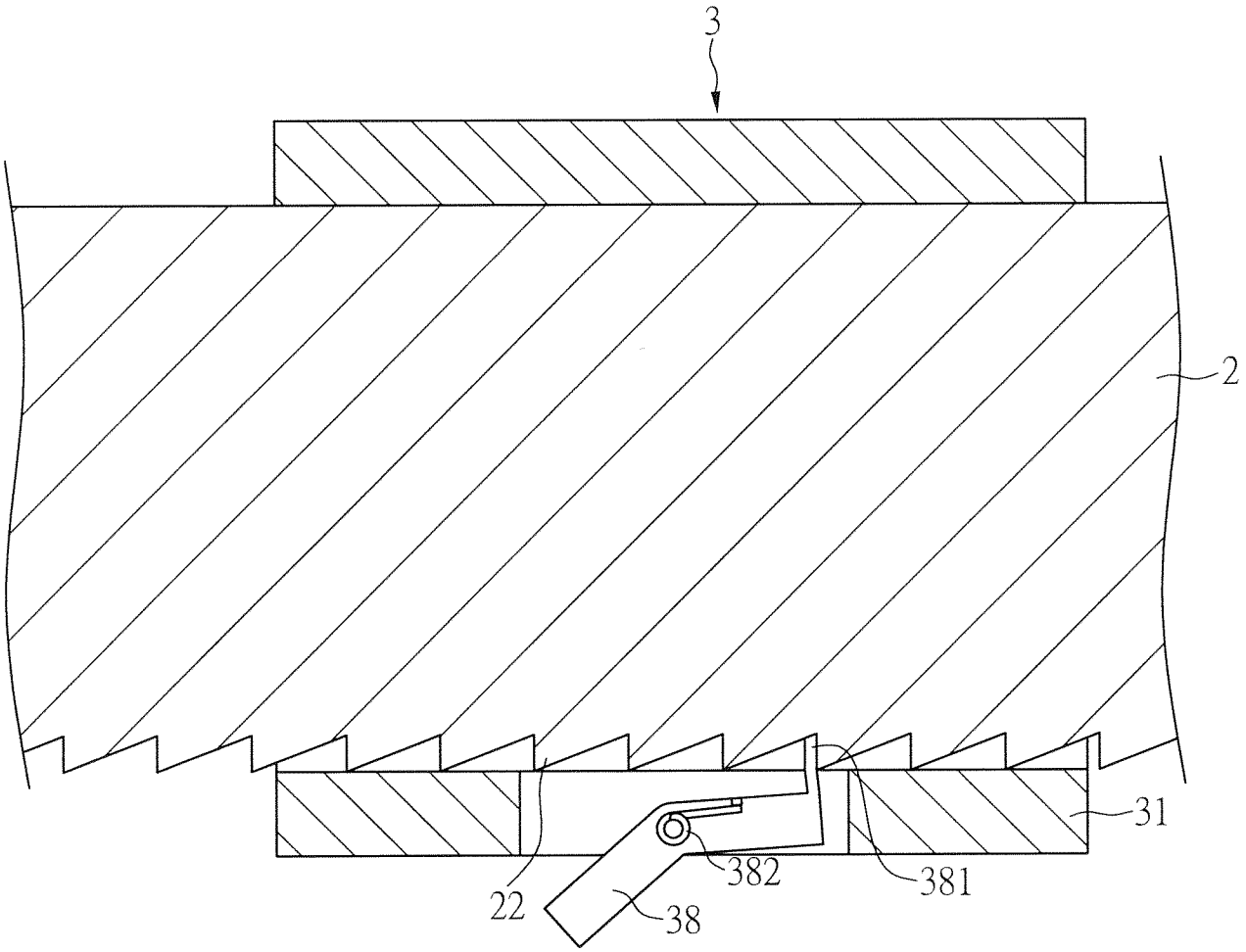
FIGS. 6 and 7 are schematic views showing a using status of the second preferred embodiment of the present invention.

With reference to FIGS. 4 to 7 for the second preferred embodiment of the present invention, the difference between this preferred embodiment and the first preferred embodiment resides on a change of the positioning mechanism. In the second preferred embodiment, the positioning mechanism includes a clutch portion disposed separately at the support arm 2 and the base 31. When these two clutch portions are combined, the base 31 just slides and moves along the support arm 2 in one direction only, and when the two clutch portions are separated, the base 31 may slide and move along the support arm 2 bi-directionally. More specifically, a row of inverted tooth structures 22 are disposed along the support arm 2, and the base 31 includes a through slot 312 penetrating through the base 31, and the through slot 312 has a pivoting hook 38, and the pivoting hook 38 has a hook portion 381, and the elastic force of a spring 382 is provided for always hooking the hook portion 381 to the inverted tooth structure 22 of the support arm 2. In FIG. 6, when the two are hooked and latched with each other, the support device 3 just can slide the base 31 in one direction along the guiding direction of the inverted tooth structure 22, but it cannot slide in the opposite direction or achieve the positioning effect.

Figure 7:
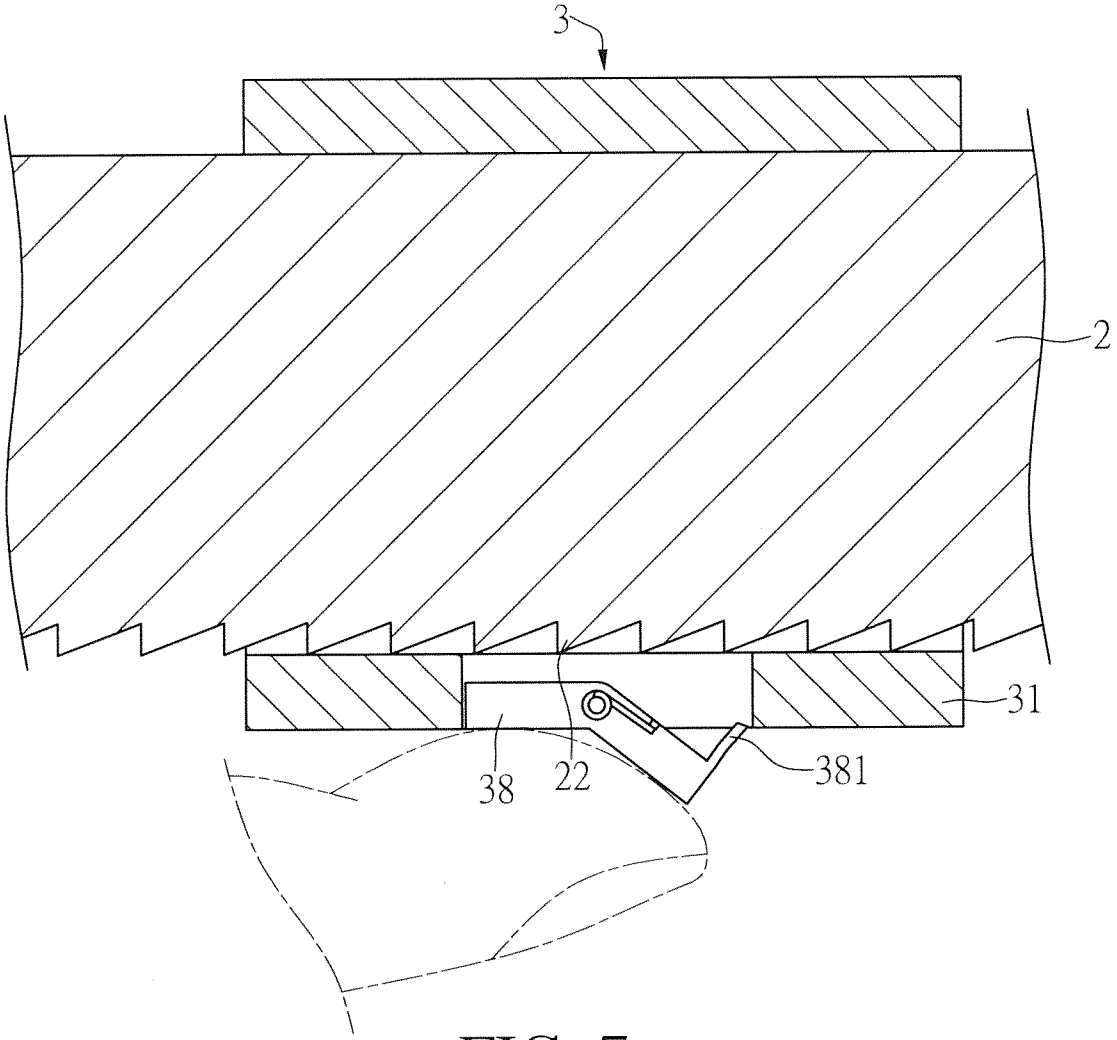

When it is necessary to adjust the position of the support device freely, the pivoting hook 38 is controlled to pivot as shown in FIG. 7, such that the hook portion 381 is separated from the inverted tooth structure 22 of the support arm 2. Therefore the support device 3 is released and able to slide in both directions freely on the support arm 2.

Figure 8:
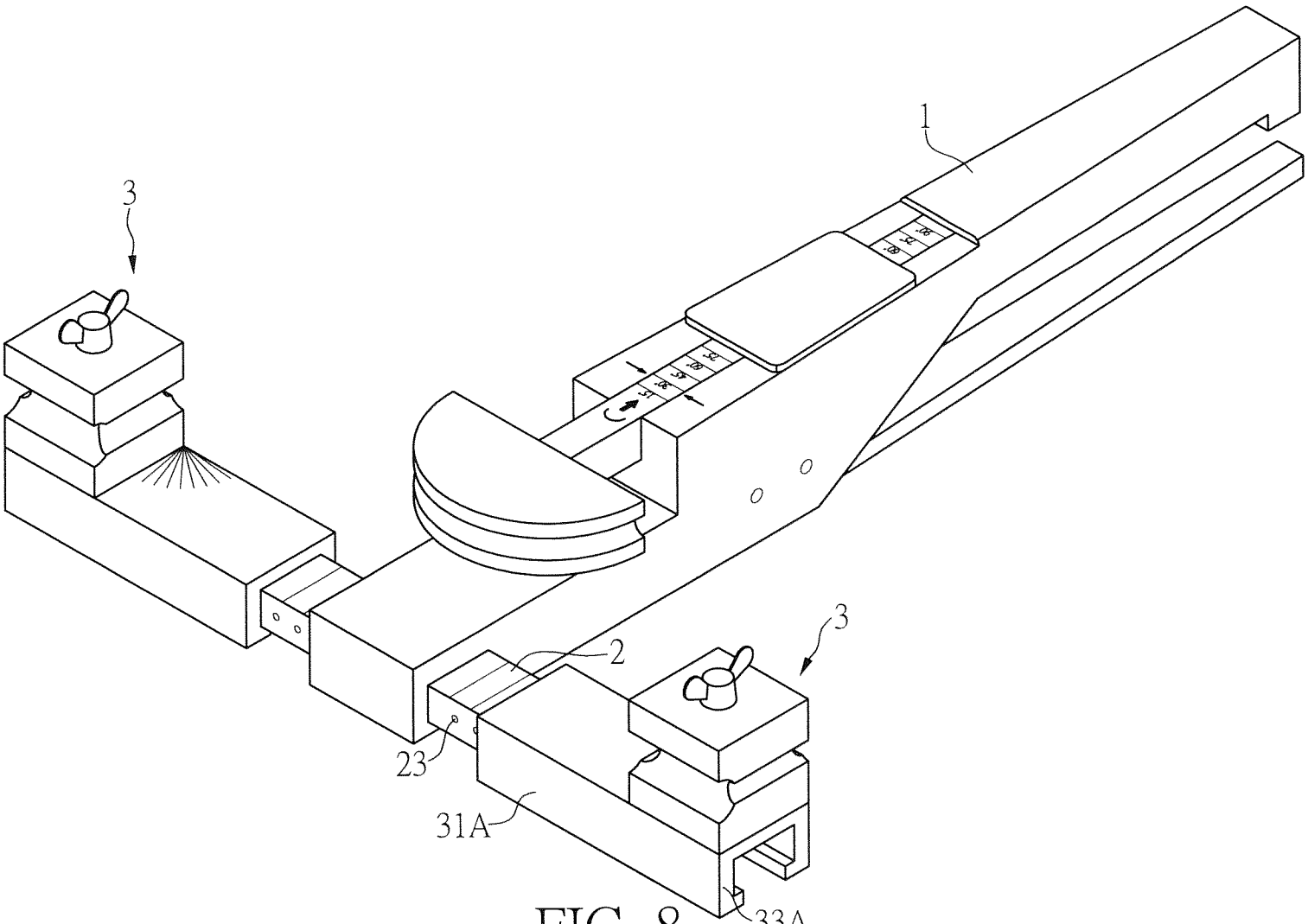
FIG. 8 is a perspective view of a third preferred embodiment of the present invention.
Figure 9:
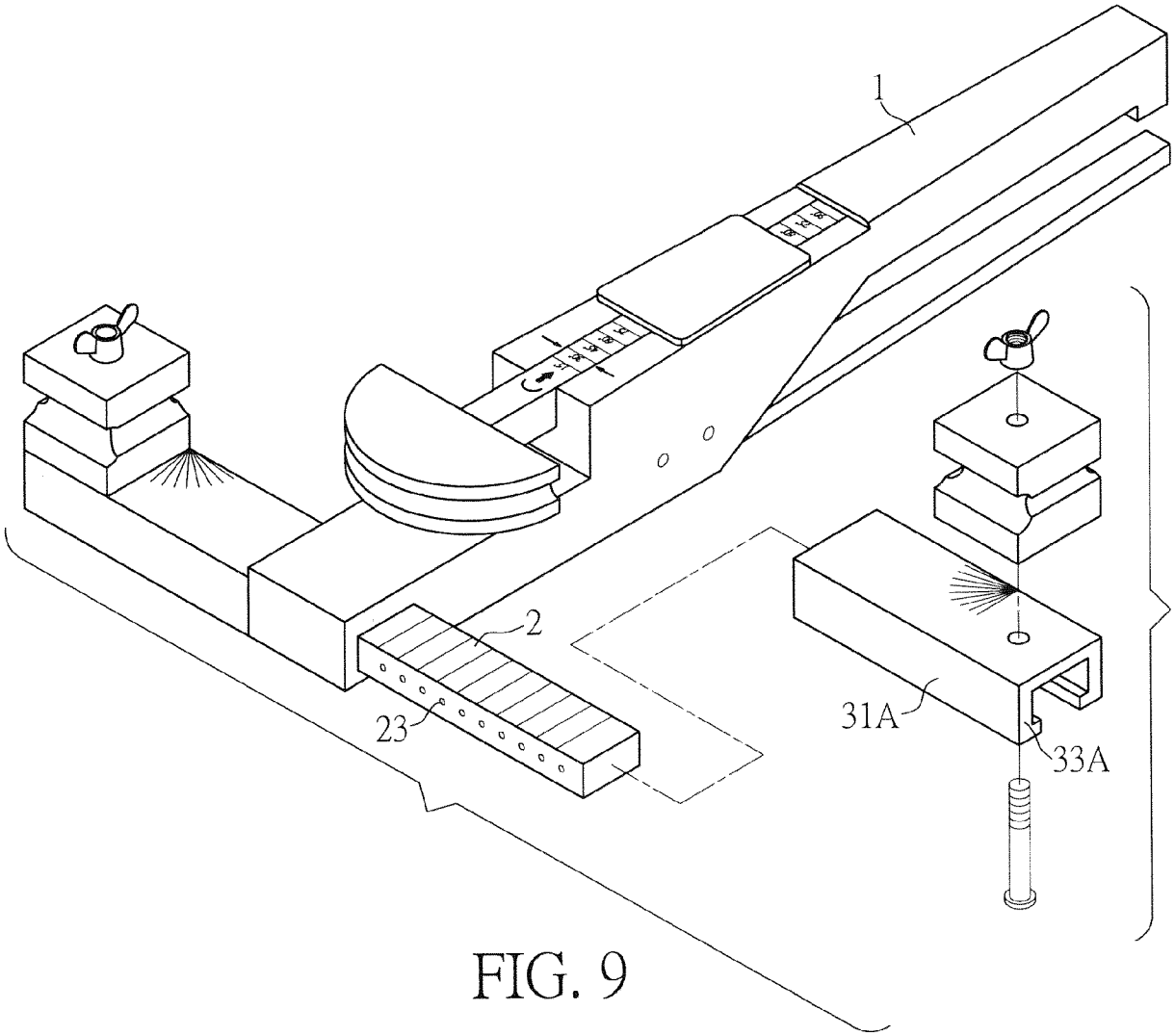
FIG. 9 is an exploded view of the third preferred embodiment of the present invention.

With reference to FIGS. 8 and 9 for the third preferred embodiment of the present invention, this preferred embodiment achieves the effect of extending the working length of the pipe bender by sliding the support device 3 on the support arm 2. Specifically, the base 31A is extended to a certain length along the extending direction of the support arm 2 to form an elongated structure. The base 31A slides and moves with respect to the support arm 2, so that a part of the base 31A may be moved out from the support arm 2 in order to extend the working length of the pipe bender.

Figure 10:
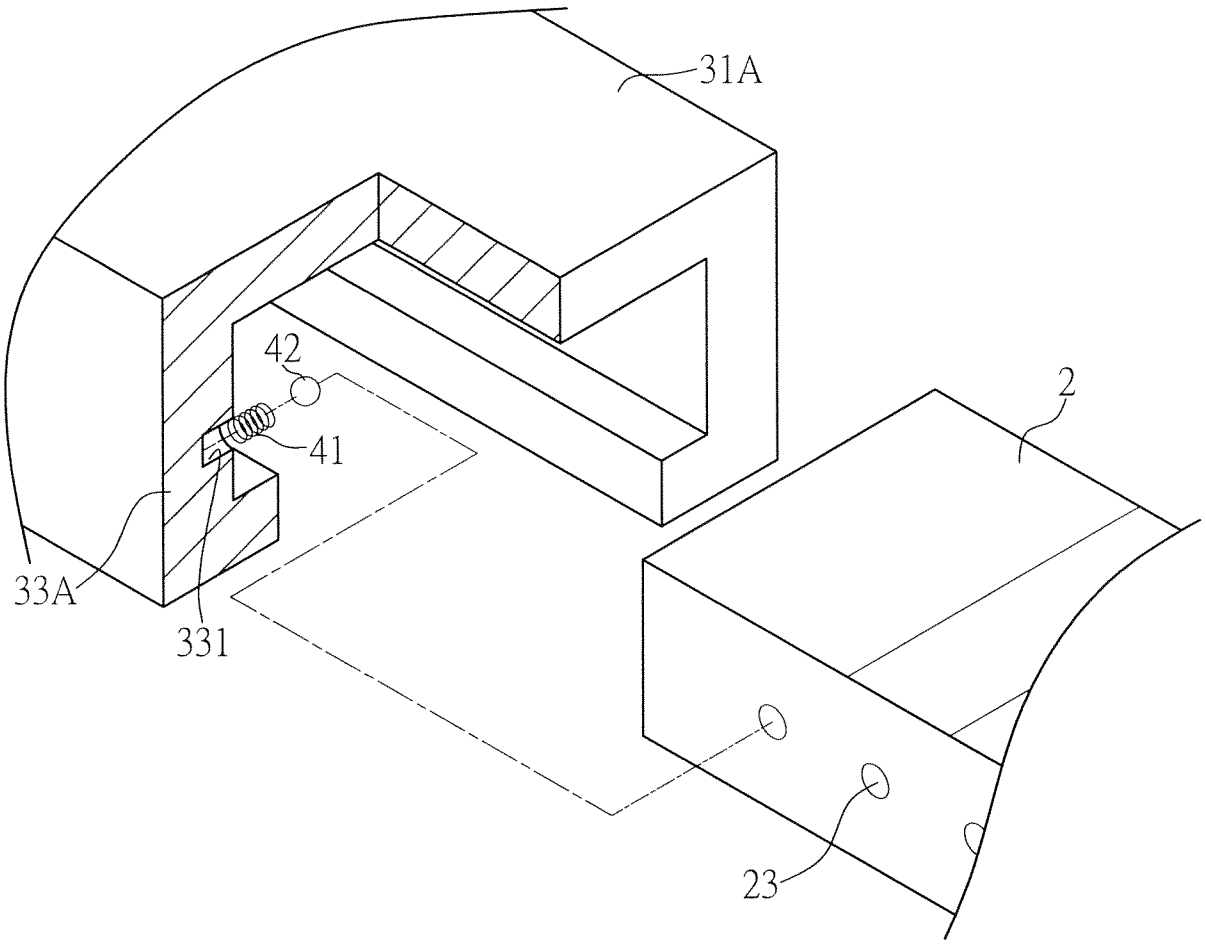
FIG. 10 is a partial perspective exploded view of the third preferred embodiment of the present invention.
Figure 11:
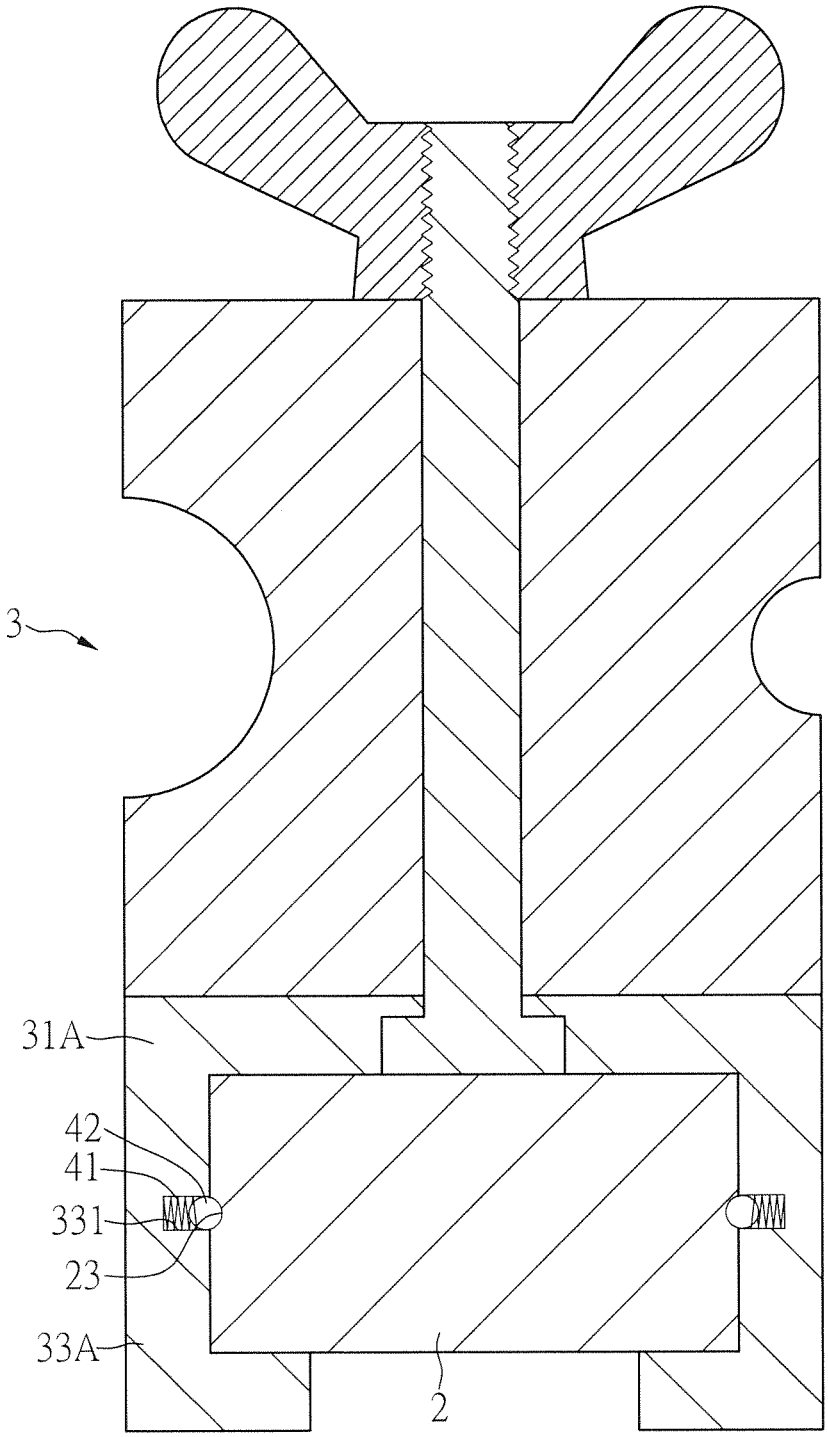
FIG. 11 is a sectional views of a support device and a support arm combined with each other in accordance with the third preferred embodiment of the present invention.

In the structure of this preferred embodiment as shown in FIGS. 10 and 11, the grip portion 33A of the base 31A has a containing hole 331 concavely formed on the grip portion 33A, and the positioning mechanism includes a spring 41 and a ball 42 sequentially installed in the containing hole 331. The spring 41 abuts the ball 42 through its elastic force and presses against the support arm 2. In addition, the support arm 2 includes a plurality of positioning portions 23 in form of recesses, so that after the support device 3 is moved to an appropriate position on the support arm 2, the ball 42 is pushed by the spring 41 to protrude from one of the positioning portions of the support arm 2 to achieve the positioning effect.

Figure 12:
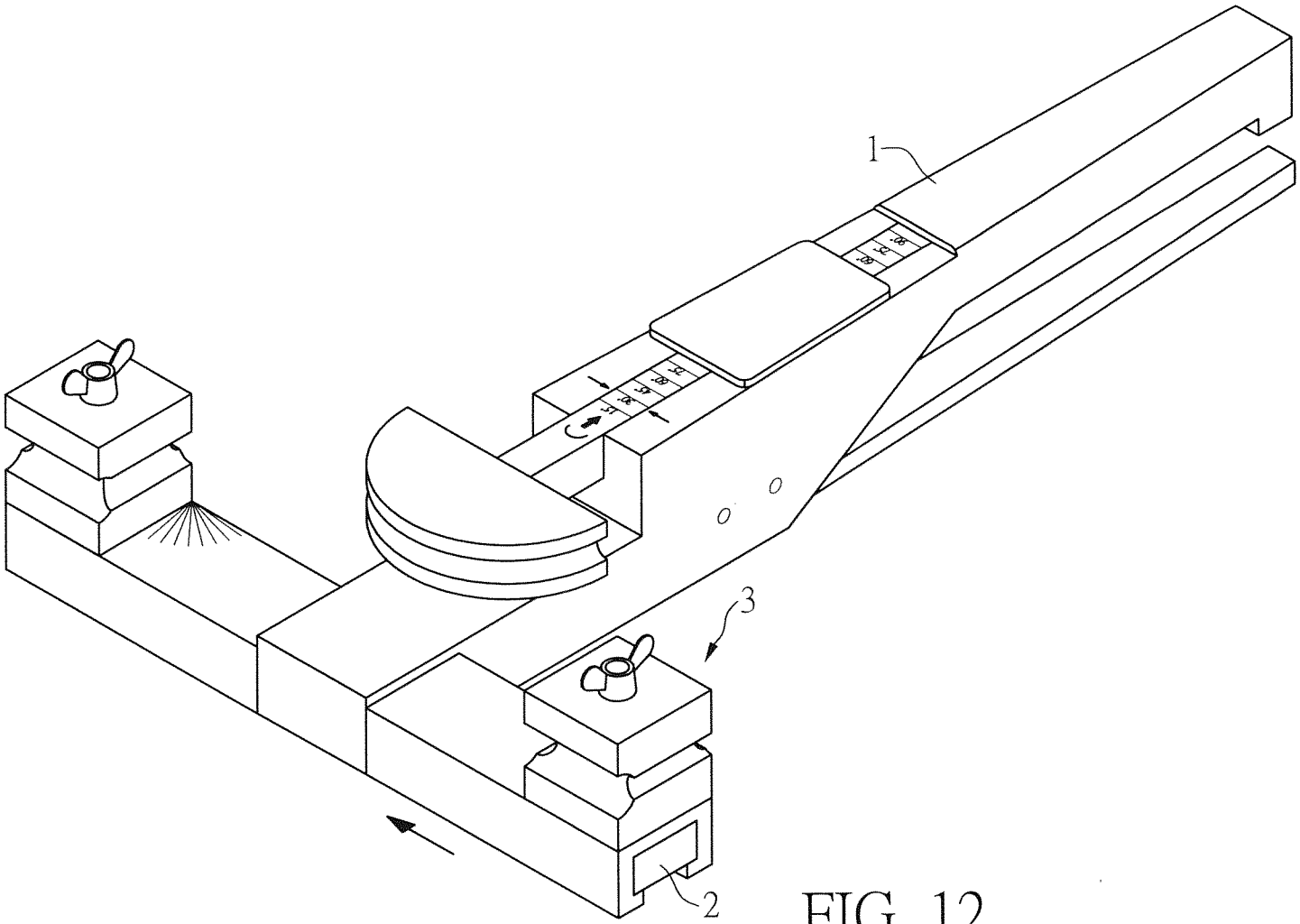
FIG. 12 is a schematic view of a storage status of the third preferred embodiment of the present invention.
Figure 13:
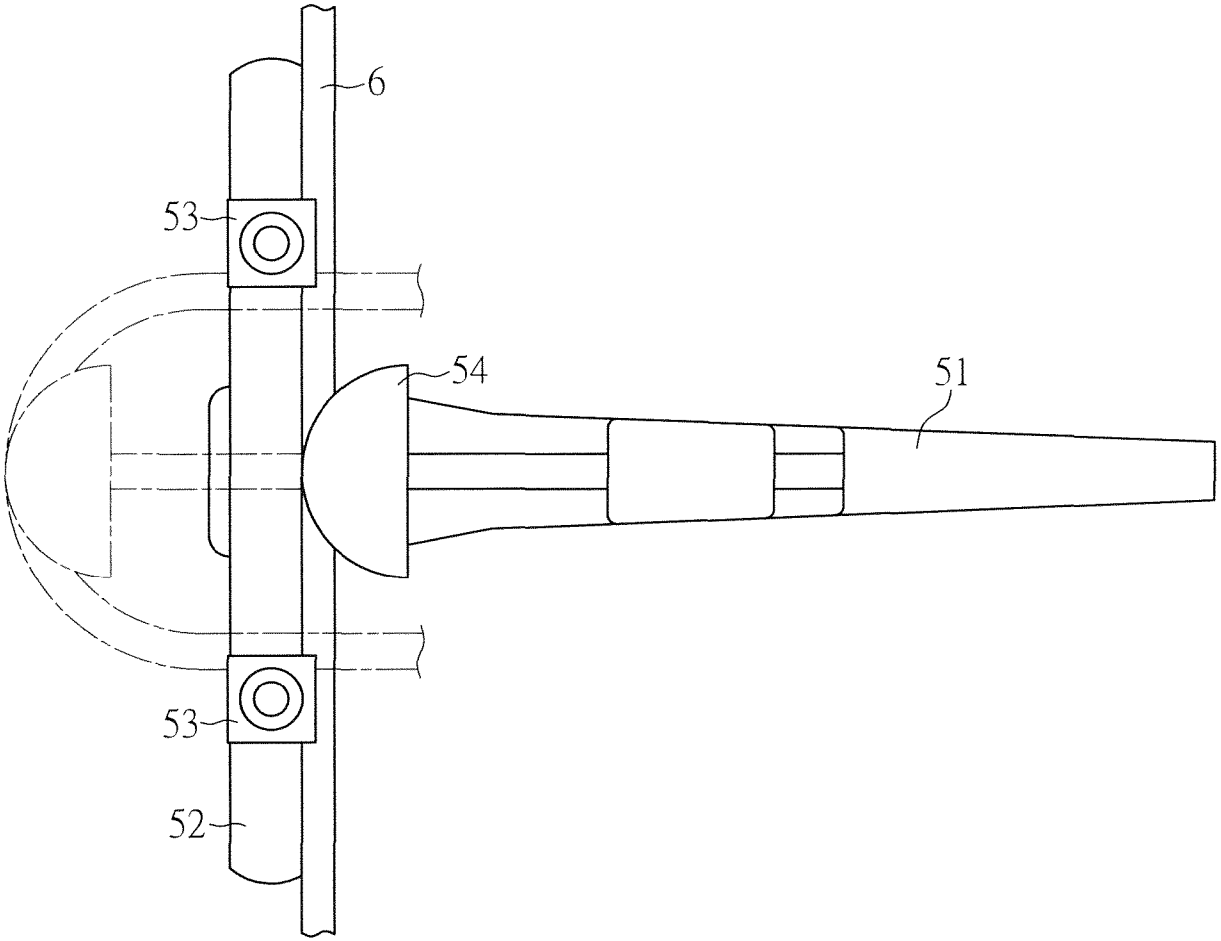
FIG. 13 PRIOR ART
FIG. 13 is a schematic planar view of a conventional pipe bender.

The advantages of this preferred embodiment reside on that the working length is variable, so that the required length can be extended if necessary, and shortened by storing the support device 3 along the support arm 2 as shown in FIG. 12 after the pipe bender is used and stored. In other words, the maximum distance transversally extended from the actuating handle 1 to both sides may be shortened to reduce the occupying space, so as to improve the convenience of storage.

What is claimed is:

1. A pipe bender, comprising:

an actuating handle having an actuating element movably installed thereon and controllable to move in a longitudinal direction relative to the actuating handle;

a support arm coupled to the actuating handle, the support arm extending transversely from opposing sides of the actuating handle, and having a plurality of positioning portions spaced along a length of the support arm; and two support devices adjustably disposed on the support arm, each support device being disposed on a respective one of the opposing sides of the actuating handle and being slidable along the support arm to a selected positioning portion for supporting a pipe during a pipe bending operation, each support device includes a base and a support block mounted on the base, the support block having a through hole formed therein and the base includes a column extending therefrom into the through hole, and the base includes a grip portion having a grip space formed therethrough through which a respective portion of the support arm passes therethrough, whereby the respective portions of the support arm are sheathed in corresponding support devices through the corresponding grip space;

wherein the column has a fixing hole extending axially therethrough hole and being in open communication with the grip space, a positioning element and an elastic element being sequentially received in the fixing hole, a fixing element being passed into the fixing hole to contact the elastic element and thereby apply an elastic force to the positioning element to engage a selected positioning portion of the support arm to position the support device on the support arm, wherein corresponding positioning portions are configured to receive respective positioning elements for selectively positioning the support device thereon.

2. The pipe bender of claim 1, wherein the fixing hole of the column is an internally threaded hole, and the fixing element has an externally threaded portion formed thereon for locking and securing the fixing element within the fixing hole.

3. A pipe bender, comprising:

an actuating handle having an actuating element movably installed thereon and controllable to move in a longitudinal direction relative to the actuating handle;

a support arm coupled to the actuating handle, the support arm extending transversely from opposing sides of the actuating handle, and having a plurality of positioning portions spaced along a length of the support arm; and two support devices adjustably disposed on the support arm, each support device being disposed on a respective one of the opposing sides of the actuating handle and being slidable along the support arm to a selected positioning portion for supporting a pipe during a pipe bending operation;

each support device includes a base and a support block mounted on the base, the base and the support block have corresponding and interlocking concave recesses and convex projections for fixing a position of the support block relative to the base, and the base includes a grip portion having a grip space formed therethrough through which a respective portion of the support arm passes therethrough, whereby the respective portions of the support arm are sheathed in corresponding support devices through the corresponding grip space.

4. The pipe bender of claim 3, wherein each base extends longitudinally a greater distance than the support block corresponding thereto and receives a substantial portion of the support arm within the grip space thereof, and each base is outwardly slidable from the actuating handle on the support arm to thereby extend a distance between the support blocks.

5. The pipe bender of claim 4, wherein the grip portion of the base has a containing hole concavely formed within the grip space thereof, the base including an elastic element and a positioning element sequentially disposed in the containing hole, the positioning element being biased by the elastic element to releasably engage a selected one of the positioning portions of the support arm.

6. A pipe bender, comprising:

an actuating handle having an actuating element movably installed thereon and controllable to move in a longitudinal direction relative to the actuating handle;

a support arm coupled to the actuating handle, the support arm extending transversely from opposing sides of the actuating handle, and having a plurality of positioning portions spaced along a length of the support arm; and two support devices adjustably disposed on the support arm, each support device being disposed on a respective one of the opposing sides of the actuating handle and being slidable along the support arm to a selected positioning portion for supporting a pipe during a pipe bending operation;

each support device includes a base and a support block mounted on the base, the base includes a grip portion having a grip space formed therethrough through which a respective portion of the support arm passes therethrough, whereby the respective portions of the support arm are sheathed in corresponding support devices through the corresponding grip space;

a positioning mechanism configured to selectively position the support device on the support arm, the positioning mechanism includes a clutch portion having a first section disposed on the support arm and a second section disposed on the base and being releasably engageable with the first section, the base being configured to slide on the support arm and move only in a first direction relative to the support arm when the first and second sections of the clutch portion are engaged each other, and moveable in the first direction and an opposing second direction when the second section is disengaged from the first section.

7. The pipe bender of claim 6, wherein the first section of the clutch portion is formed by an inverted tooth structure located along a length of the support arm, and the second section of the clutch portion is a hook pivotally mounted to the base to be in correspondence the inverted tooth structure on the support arm.

* * * * *